US006084522A

United States Patent [19]

Addy

[11] Patent Number: 6,084,522

[45] Date of Patent: Jul. 4, 2000

[54] TEMPERATURE SENSING WIRELESS SMOKE DETECTOR

[75] Inventor: Kenneth L. Addy, Massapequa, N.Y.

[73] Assignee: Pittway Corp., Chicago, Ill.

[21] Appl. No.: 09/280,620

[22] Filed: Mar. 29, 1999

[51] Int. Cl.[7] ..... G08G 17/10

[52] U.S. Cl. ..... 340/630; 340/511; 340/521; 340/539; 340/578

[58] Field of Search ..... 340/511, 521, 340/522, 577, 578, 579, 584, 628, 629, 630, 539

[56] References Cited

U.S. PATENT DOCUMENTS

| | | | |
|---|---|---|---|
| 4,211,362 | 7/1980 | Johnson | 340/630 |
| 4,249,169 | 2/1981 | Malinowski | 340/630 |
| 4,381,503 | 4/1983 | Kobayashi | 340/521 |
| 4,470,047 | 9/1984 | Vogt et al. | 340/511 |
| 5,260,687 | 11/1993 | Yamauchi et al. | 340/521 |
| 5,450,066 | 9/1995 | Brighenti et al. | 340/589 |
| 5,530,433 | 6/1996 | Morita | 340/630 |
| 5,565,852 | 10/1996 | Peltier et al. | 340/628 |
| 5,670,948 | 9/1997 | Mochizuki et al. | 340/630 |
| 5,764,143 | 6/1998 | Buccola | 340/521 |
| 5,818,326 | 10/1998 | Winterble et al. | 340/628 |

*Primary Examiner*—Daniel J. Wu

*Attorney, Agent, or Firm*—Greenberg Traurig; Anthony R. Barkume

[57] ABSTRACT

A wireless integrated smoke detector and temperature monitoring device. The device comprises a photoelectric sensor for determining the presence of smoke, thermistor for providing a temperature signal reflective of the temperature level, processing means for monitoring the smoke and temperature, and transmission means for transmitting messages to the alarm system controller. Rather than transmitting the actual temperature to the system controller, the transmitter transmits a status message which comprises status bits for low temperature trouble condition, smoke or heat alarm, and also low temperature trouble condition with smoke or heat alarm. To conserve battery power, the device alternates between a sleep mode and a wake mode. During the wake mode the trouble conditions are checked by the processor and if necessary, a status message is transmitted.

10 Claims, 3 Drawing Sheets

TRANSMITTED STATUS BYTE FROM ESN5421-X

| BIT# | DEFINITION | |
|---|---|---|
| 1 | 1=LOOP INPUT FAULT | 0=LOOP INPUT RESTORE |
| 2 | 1=AUX INPUT 1 HIGH | 0=AUX INPUT 1 LOW |
| 3 | 1=AUX INPUT 2 HIGH | 0=AUX INPUT 2 LOW |
| 4 | 1=AUX INPUT 3 HIGH | 0=AUX INPUT 3 LOW |
| 5 | 1=LOW BATTERY LATCH SET | 0=LOW BATTERY LATCH RESET |
| 6 | 1=SUPERVISION TRANSMISSION | 0=NON-SUPERVISION TRANSMISSION |
| 7 | 1=POR TRANSMISSION | 0=NON-POR TRANSMISSION |
| 8 | ALWAYS LOW(=0). RESERVED FOR WIRELESS KEYPAD | |

FIG.2A

THE SIGNIFICANCE OF THE FIRST FOUR (4) BITS OF THE STATUS BYTE SHALL BE AS FOLLOWS:

| BIT#1 (LOOP) | BIT#2 (AUX 1) | BIT#3 (AUX 2) | BIT#4 (AUX 3) | SIGNIFICANCE |
|---|---|---|---|---|
| 0 | 0 | 0 | 0 | Normal Mode |
| 0 | 0 | 1 | 0 | Low sensitivity(Dirty)or High Sensitivity(Pre-Alarm) maintenance condition |
| 0 | 0 | 0 | 1 | Low ambient temperature trouble condition |
| 1 | 0 | 1 | 1 | Test Alarm (with detector mounted to bracket) |
| 1 | 0 | 0 | 0 | Smoke or Heat Alarm |
| 1 | 0 | 0 | 1 | Smoke or Heat Alarm with low ambient temperature trouble condition |
| 1 | 0 | 1 | 0 | Smoke or Heat Alarm with sensitivity maintenance condition |
| 0 | 1 | 0 | 0 | Temper Mode |
| 1 | 1 | 0 | 0 | Test Alarm(with detector removed from bracket) |

FIG.2B

TEMPERATURE SENSING WIRELESS SMOKE DETECTOR

BACKGROUND OF THE INVENTION

The present invention relates to smoke and fire detection devices in alarm systems, and in particular to low cost devices which are in wireless communication with a central control unit and can detect temperature conditions that are out of range for both hot and cold extremes.

Modern fire detectors include both smoke detection methods and heat detection circuitry, for example ADEMCO's 5808 detector includes a photoelectric smoke detector and a thermistor which is set to trip if the temperature rises above 135 degrees Fahrenheit. The thermistor is necessary for fires which may not generate smoke quickly enough for the alarm to be raised by the smoke detection circuitry alone.

In addition there are low temperature or freeze detectors available, such as ADEMDO's 5816temp, which are commonly installed in uninhabited vacation homes in order to raise an alarm if a freezing pipe situation could possibly occur. Since the alarm system in these homes most likely contains fire detectors, it would be convenient and less costly to use a common thermistor circuit to sense both high and low temperature.

Although U.S. Pat. No. 5,764,143 teaches the use of a thermistor (already in the alarm system for temperature compensation of a PIR sensor) for sensing high and low temperature conditions, it does not teach the use of a thermistor located in a wireless smoke detector. Since a wireless smoke detector transmits data via RF communication, it needs to comply with the control/data restrictions imposed by the FCC. A wireless smoke detector also uses a battery for power; giving rise to the need for battery conservation techniques.

It is therefore an object of the present invention to provide a wireless integrated smoke detector and temperature monitoring device which detects fire and high and low temperature trouble conditions.

It is a further object of the present inventing to provide a wireless integrated smoke detector and temperature monitoring device which conserves battery power to ensure good battery life.

It is yet a further object of the present invention to provide a wireless integrated smoke detector and temperature monitoring device which complies with transmission data restrictions imposed by the FCC.

SUMMARY OF THE INVENTION

In accordance with these and other objects, the present invention is a wireless integrated smoke detector and temperature monitoring device. The device comprises a photoelectric sensor-for determining the presence of smoke, a thermistor for providing a temperature signal indicative of the temperature level, processing means for monitoring the smoke and temperature, and transmission means for transmitting messages to the alarm system controller. The processing means comprises two comparators for comparing the temperature signal to a high temperature threshold and a low temperature threshold, and a processor that monitors the output of the comparators. When the output of the comparators provides an alarm condition (i.e. the signal level becomes high) the processor generates a status message which is sent to the transmitter to transmit to the alarm system controller. The high temperature and low temperature thresholds are adjustable and are set by either the installer or the factory which manufactures the device. Rather than transmitting the actual temperature data to the system controller, the transmitter transmits a status message which comprises status bits for low temperature trouble condition, smoke or heat alarm, and also low temperature trouble condition with smoke or heat alarm. This condition occurs when there is a low temperature and smoke (most likely from a different room or area). The use of status bits decreases the amount of data transmitted to the system controller allowing the device to meet FCC data transmission requirements.

The method of the present invention to use a wireless integrated smoke detector to detect an out of range temperature condition, comprises the steps of sensing the ambient temperature in close proximity to the thermistor, comparing the ambient temperature to a low and high temperature threshold, updating a status bit in a status message to indicate a low or high temperature trouble condition when the ambient temperature is below the low temperature threshold or above the high temperature threshold, and transmitting the status message from the transmitter.

To conserve battery power, the device alternates between a sleep mode and a wake mode. During the wake mode the trouble conditions are checked by the processor and when necessary, a status message is transmitted. During the sleep mode, the battery power is conserved by causing the processor and its circuits to be idle. The sleep mode is entered after the processor starts a 10 second timer, which happens at the end of the wake mode processing (and if necessary status message transmission). The timer interrupts the processor causing it to go from the battery conservation sleep mode to the monitoring wake mode.

BRIEF DESCRIPTION OF THE DRAWING

FIGS. 2A and 2B are diagrams of the transmitted status byte; and

DETAILED DESCRIPTION OF THE PREFERRED EMBODIMENT

Figure 1:
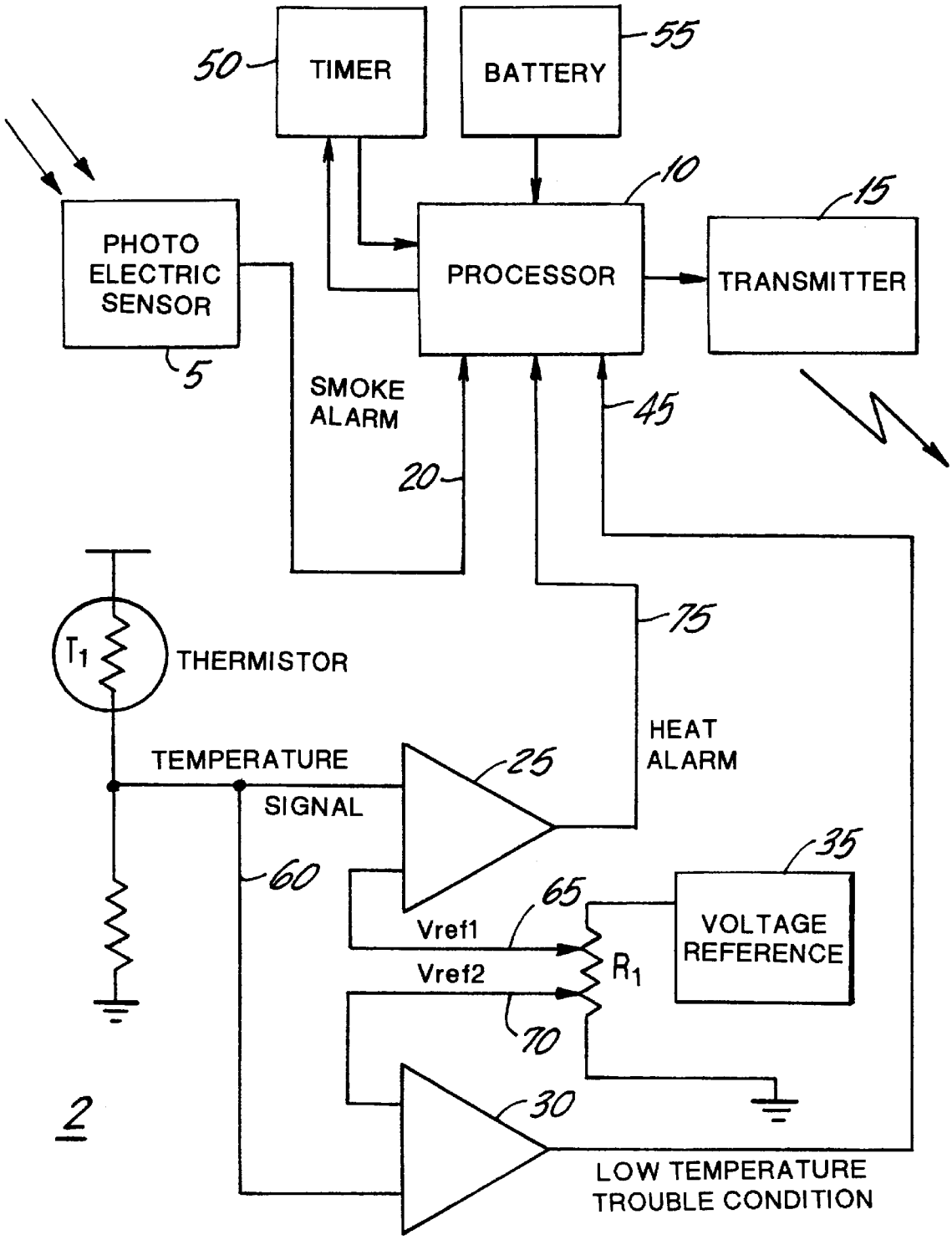
FIG. 1 is a block diagram of the preferred embodiment of the present invention.

Referring to FIG. 1, a wireless integrated smoke detector and temperature monitoring detector 2 is shown. The photoelectric sensor 5 detects smoke, and the thermistor T1 senses the ambient temperature, both in a manner well know in the art. In the present invention, the temperature signal 60 that is output from thermistor T1 is compared with two reference voltages Vref1 65 and Vref2 70 by comparators 25 and 30, respectively. Comparator 25 generates a heat alarm signal 75 and comparator 30 generates a low temperature trouble condition 45. The reference voltages 65 and 70 are generated by the voltage reference 35 and are adjusted at potentiometer means Ri by the installer and/or the factory which manufactures them. The references voltage 65 is typically set to cause the heat alarm 75 to be high when the thermistor senses an ambient temperature greater than 135 degrees Fahrenheit. The second reference voltage 70 is typically set to cause the low temperature trouble condition 45 to be high when the thermistor senses an ambient temperature less than 45 degrees Fahrenheit. The smoke alarm signal 20, heat alarm signal 75, and low temperature trouble condition signal 45 are input to the processor 10. The processor 10 monitors these signals along with other conditions, such as power of the battery 55 (all well known in the art), and when a trouble condition is present, the processor 10 sends a status message to the transmitter 15 to transmit. The processor then sets timer 50 for 10 seconds and goes into a sleep mode. The timer 50 causes the processor 10 to wake up from the sleep mode and check the alarm signals 20, 45 and 75. In the sleep mode, the processor and its circuits are in a very low current idle mode to conserve battery power.

The processor transmits to the system controller a status message containing status bits indicative of a trouble condition rather than data indicative of the ambient temperature. The use of status bits allows the device to meet FCC data transmission requirements, wherein the transmission of the ambient temperature is not permitted. The status byte transmitted by transmitter 15 is shown in FIG. 2A. The significance of the first four bits are shown in the chart in FIG. 2B. The other bits in the status byte are typical status conditions which are well known in the art and not discussed here. For a normal (no alarm) mode, all four first bits are low. The bits which are significant for the present invention will be discussed. Bit 4 only is set when there is a low temperature trouble condition, bit 1 only is set when there is a smoke or heat alarm, and bits 1 and 4 only are set when there is a smoke or heat alarm with a low temperature trouble condition. This condition occurs when there is a low temperature trouble condition and smoke at the same time, for example, an electrical fire in a snow covered cabin in Vermont.

Figure 3:
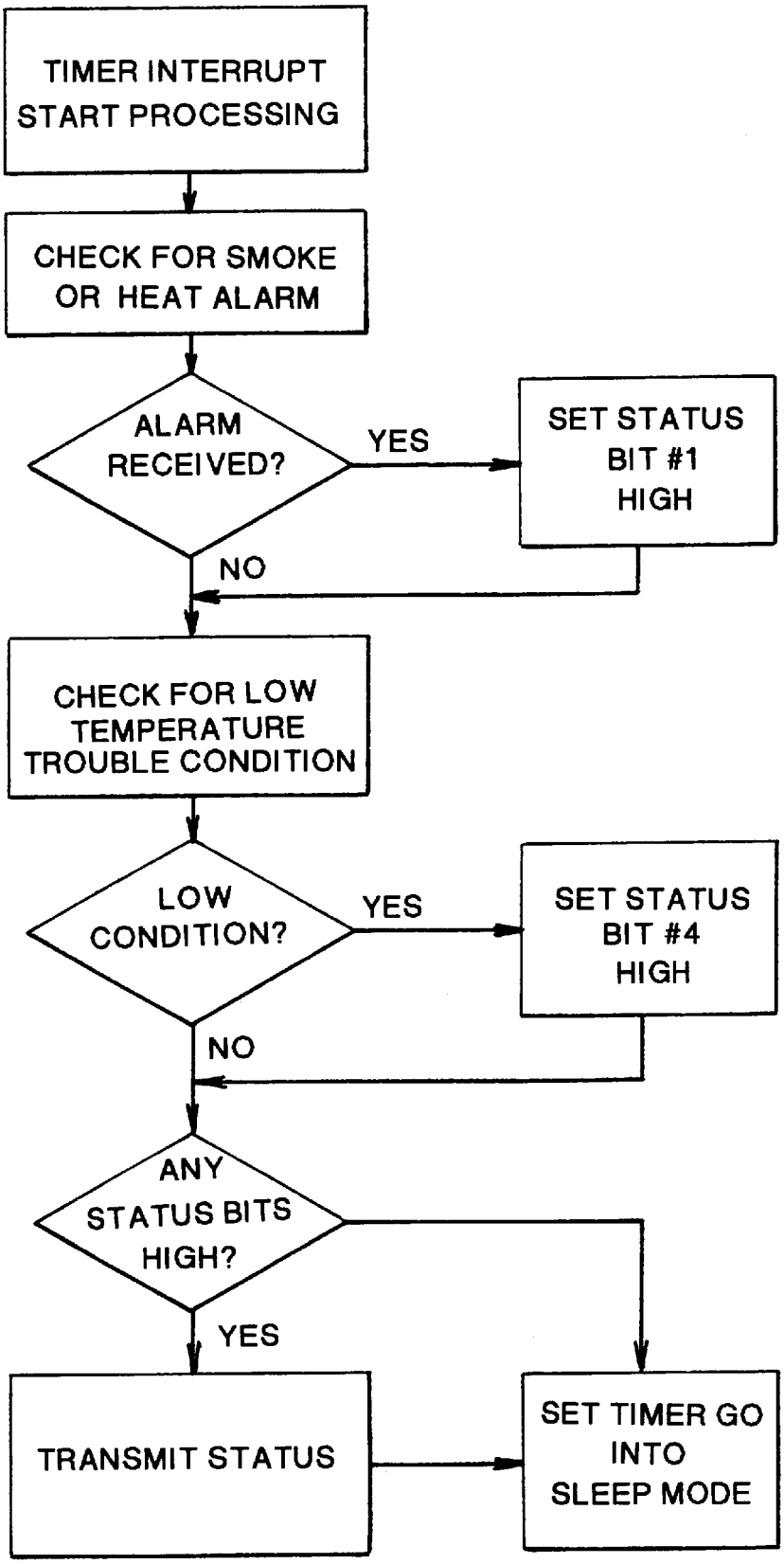
FIG. 3 is a flowchart of the operation of the preferred embodiment of the present invention.

FIG. 3 shows a flow chart of the logic operation of the present invention. Upon power up or timer 50 interrupt, the processor 10 starts checking for a smoke alarm 20 or heat alarm 75. If an alarm signal is high, status bit #1 is set high. Next the low temperature trouble condition is checked. If the signal is high, status bit #4 is set high. The processor 10 then checks to see if any status bits have been set high. If so, it transmits the status message. The processor 10 then sets the timer for 10 seconds and goes into a sleep mode in order to save battery power.

It will be apparent to those skilled in the art that modifications to the specific embodiment described herein may be made while still being within the spirit and scope of the present invention. For example, the status byte may be formatted in many different ways, and that the invention is not dependent on a particular format. The flow of the processor described above may be performed in many different ways and that the invention is not dependent on a particular program flow.

In addition, the comparison of the temperature signal 60 from the thermistor T1 may be performed in many different ways including digitizing the temperature signal 60 and having the processor input the digital signal and compare it to a number programmed in software.

Finally, the conservation of battery power may be performed in many different ways. For example, the sleep time may be longer or shorter, or the timer may be free running rather than controlled by the processor.

I claim:

1. A wireless integrated smoke detector and temperature monitoring device comprising:

a) a photoelectric sensor for determining the presence of smoke and for providing a smoke alarm signal, b) temperature sensing means for providing a temperature signal indicative of the temperature level, c) first comparing means for comparing said temperature signal to a high temperature threshold, and for providing a first output signal indicative of a high temperature status when said temperature signal is greater than said high temperature threshold, d) second comparing means for comparing said temperature signal to a low temperature threshold, and for providing a second output signal indicative of a low temperature status when said temperature signal is less than said low temperature threshold, e) processing means coupled to said photoelectric sensor and said first and second comparing means for monitoring said smoke alarm signal and said first and second output signals and for providing a status message indicative of the state of said smoke alarm signal, said first output signal, and said second output signal, and f) transmission means for transmitting said status message.

2. The device of claim 1 further comprising a battery for supplying power thereto, wherein said device alternates between a sleep mode and a wake mode, wherein battery power is conserved during the sleep mode, and wherein said processing means monitors said smoke alarm signal and said first and second output signal during said wake mode.

3. The device of claim 2 further comprising timing means for switching said device from said sleep mode to said wake mode.

4. The device of claim 1 wherein said low temperature threshold is adjustable.

5. The device of claim 1 wherein said high temperature threshold is adjustable.

6. The device of claim 1 wherein said temperature sensing means is a thermistor.

7. The device of claim 1 wherein said status message comprises a status bit representative of a smoke or heat alarm with a low temperature condition.

8. In a wireless integrated smoke detector comprising a photoelectric sensor for determining the presence of smoke, a temperature sensing means for sensing the ambient temperature, comparing means for determining a trouble condition, processing means for generating status messages and a transmitter for transmitting said status messages, a method for using said wireless integrated smoke detector to detect out of range temperature conditions, comprising the steps of a) sensing the ambient temperature in close proximity to said smoke detector, b) comparing said ambient temperature to a low temperature threshold and a high temperature threshold, c) updating a first status bit in a status message to indicate a low temperature trouble condition when said ambient temperature is below said low temperature threshold, and updating a second status bit in said status message to indicate a high temperature trouble condition when said ambient temperature is above said high temperature threshold, and d) transmitting from said transmitter said status message.

9. The method of claim 8 further comprising a sleep mode and a wake mode, wherein battery power is conserved during the sleep mode, and wherein said status message is periodically transmitted only during said wake mode.

10. The method of claim 8 further comprising a third status bit in said status message representative of a smoke or heat alarm with a low temperature condition.

* * * * *